US007081581B2

(12) United States Patent
Allamanche et al.

(10) Patent No.: US 7,081,581 B2
(45) Date of Patent: Jul. 25, 2006

(54) METHOD AND DEVICE FOR CHARACTERIZING A SIGNAL AND METHOD AND DEVICE FOR PRODUCING AN INDEXED SIGNAL

(75) Inventors: Eric Allamanche, Nuremberg (DE); Juergen Herre, Buckenhof (DE); Oliver Hellmuth, Erlangen (DE); Bernhard Froeba, Buchenbach (DE)

(73) Assignee: m2any GmbH, Garching (DE)

( * ) Notice: Subject to any disclaimer, the term of this patent is extended or adjusted under 35 U.S.C. 154(b) by 233 days.

(21) Appl. No.: 10/469,468

(22) PCT Filed: Feb. 26, 2002

(86) PCT No.: PCT/EP02/02005

§ 371 (c)(1),
(2), (4) Date: Dec. 1, 2003

(87) PCT Pub. No.: WO02/073592

PCT Pub. Date: Sep. 19, 2002

(65) Prior Publication Data

US 2004/0074378 A1 Apr. 22, 2004

(30) Foreign Application Priority Data

Feb. 28, 2001 (DE) ..... 101 09 648

(51) Int. Cl.
*G10H 7/00* (2006.01)

(52) U.S. Cl. ..... 84/616; 704/233

(58) Field of Classification Search ..... 84/616, 84/654; 704/233
See application file for complete search history.

(56) References Cited

U.S. PATENT DOCUMENTS

| | | | | |
|---|---|---|---|---|
| 5,210,820 | A | 5/1993 | Kenyon | 395/2 |
| 5,402,339 | A | 3/1995 | Nakashima et al. | 364/419.9 |
| 5,510,572 | A | 4/1996 | Hayashi et al. | 84/609 |
| 5,918,203 | A | 6/1999 | Herre et al. | 704/205 |
| 5,918,223 | A | 6/1999 | Blum et al. | 707/1 |
| 6,185,527 | B1 | 2/2001 | Petkovic et al. | 704/231 |

OTHER PUBLICATIONS

Wang et al., "Multimedia Content Analysis," IEEE Signal Processing Magazine, Nov. 2000, pp. 12-36.
"Psychoacoustic model 1," ISO/IEC, 1993, pp. 114-120.

(Continued)

*Primary Examiner*—Jeffrey W. Donels
(74) *Attorney, Agent, or Firm*—Thomas, Kayden, Horstemeyer & Risley, LLP

(57) ABSTRACT

In a method for characterizing a signal, which represents an audio content, a measure for a tonality of the signal is determined, whereupon a statement is made about the audio content of the signal based on the measure for the tonality of the signal. The measure for the tonality of the signal for the content analysis is robust against a signal distortion, such as by MP3 encoding, and has a high correlation to the content of the examined signal.

15 Claims, 3 Drawing Sheets

OTHER PUBLICATIONS

"Psychoacoustic model 2," ISO/IEC, 1993, pp. 133-137.
PCT International Search Report for PCT/EP02/02005.
Wold et al., "Content-Based Classification, Search, and Retrieval of Audio," IEEE Multimedia, IEEE Computer Society, Nov. 3, 1996, pp. 27-36.
Allamanche et al., "Content-based Identification of Audio Material Using MPEG-7 Low Level Description," Proceedings Annual International Symposium on Music Information Retrieval, Oct. 15, 2001, pp. 1-8.
International Standards Organization, Final Text for DIS 11172-3 (rev. 2): Information Technology—Coding of Moving Pictures and Associated Audio for Digital Storage Media—Part 1—Coding at up to about 1.5 Mbit/s (ISO/IEC JTC 1/SC 29/WG 11 N 0156), Apr. 20, 1992, No. 147, pp. 174-337.

METHOD AND DEVICE FOR CHARACTERIZING A SIGNAL AND METHOD AND DEVICE FOR PRODUCING AN INDEXED SIGNAL

BACKGROUND OF THE INVENTION

1. Field of the Invention:

The present invention relates to characterizing of audio signals with regard to their content and particularly to a concept for classifying and indexing, respectively, of audio pieces with respect to their content, to enable an inquirability of such multimedia data.

2. Description of the Related Art:

Over the last years, the availability of multimedia data material, i.e. of audio data has increased significantly. This development is due to a series of technical factors. These technical factors comprise, for example, the broad availability of the internet, the broad availability of efficient computers as well as the broad availability of efficient methods for data compression, i.e. source encoding, of audio data. One example therefore is MPEG 1/2 layer 3, which is also referred to as MPEG 3.

The huge amounts of audiovisual data that are available worldwide on the Internet, require concepts, which make it possible to evaluate, catalogize or administrate these data according to content criteria. There is a demand to search and find multimedia data in a calculated way according to the specification of useful criteria.

This requires the usage of so-called "content-based" techniques, which extract so-called features from the audiovisual data, which represent important characteristic content properties of the signal of interest. Based on such features and combinations of such features, respectively, similarity relations and common features, respectively, between the audio signals can be derived. This process is generally accomplished by comparing and interrelating, respectively, the extracted feature values from the different signals, which are also referred to as "pieces" herein.

The U.S. Pat. No. 5,918,223 discloses a method for content-based analysis, storage, retrieval and segmentation of audio information. An analysis of audio data generates a set of numerical values, which is also referred to as feature vector, and which can be used to classify and rank the similarity between individual audio pieces, which are typically stored in a multimedia data bank or on the world wide web.

In addition, the analysis enables the description of user-defined classes of audio pieces based on an analysis of a set of audio pieces, which are all members of a user-defined class. The system is able to find individual sound portions within a longer sound piece, which makes it possible that the audio recording is automatically segmented into a series of shorter audio segments.

As features for the characterization and classification, respectively, of audio pieces with regard to their content, the loudness of a piece, the bass content of a piece, the pitch, the brightness, the bandwidth and the so-called Mel-frequency Cepstral coefficients (MFCCs) are used in periodic intervals in the audio piece. The values per block or frame are stored and subjected to a first derivation. Thereupon, specific statistic quantities, such as the mean value or the standard deviation, are calculated from every one of these features including their first deviations, to describe a variation over time. This set of statistical quantities forms the feature vector. The feature vector of the audio piece is stored in a data bank, associated to the original file, where a user can access the data bank to fetch respective audio pieces.

The data bank system is able to quantify the distance in an n-dimensional space between two n-dimensional vectors. It is further possible to generate classes of audio pieces by specifying a set of audio pieces, which belongs into a class. Exemplary classes are twittering of birds, rock music, etc. The user is enabled to search the audio piece data bank by using specific methods. The result of a search is a list of sound files, which are listed in an ordered way according to their distance from the specified n-dimensional vector. The user can search the data bank with regard to similarity features, with regard to acoustic and psychoacoustic features, respectively, with regard to subjective features or with regard to special sounds, such as buzzing of bees.

The expert publication "Multimedia Content Analysis", Yao Wang etc., IEEE Signal Processing Magazine, November 2000, pp. 12 to 36, discloses a similar concept to characterize multimedia pieces. As features for classifying the content of a multimedia piece, time domain features or frequency domain features are suggested. These comprise the volume, the pitch as base frequency of an audio signal form, spectral features, such as the energy content of a band with regard to the total energy content, cut-off frequencies in the spectral curve, etc. Apart from short-time features, which concern the named quantities per block of samples of the audio signal, long-time quantities are suggested as well, which refer to a longer time interval of the audio piece.

Different categories are suggested for the characterization of audio pieces, such as animal sounds, bell sounds, sounds of a crowd, laughter, machine sounds, musical instruments, male voice, female voice, telephone sounds or water sounds.

The problem of the selection of the used features is that the calculating effort for extracting a feature is to be moderate to obtain a fast characterization, but at the same time the feature is to be characteristically for the audio piece, such that two different pieces also have distinguishable features.

Another problem is the robustness of the feature. The named concepts do not relate to robustness criteria. If an audio piece is characterized immediately after its generation in the sound studio and provided with an index, which represents the feature vector of the piece and, so to speak, forms the essence of the piece, the probability of recognizing this piece is quite high, when the same undistorted version of this piece is subjected to the same method, which means the same features are extracted and the feature vector is then compared with a plurality of feature vectors of different pieces in the data bank.

This will become problematic, however, when an audio piece is distorted prior to its characterization, so that the signal to be characterized is no longer identical to the original signal, but has the same content. A person, for example, who knows a song, will recognize this song even when it is noisy, when it is louder or softer or when it is played in a different pitch than originally recorded. Another distortion could, for example, also have been achieved by a lossy data compression, such as by an encoding method according to an MPEG standard, such as MP3 or AAC.

If a distortion and data compression, respectively, leads to the feature being strongly affected by the distortion and data compression, respectively, this would mean that the essence gets lost, while the content of the piece is still recognizable for a person.

The U.S. Pat. No. 5,510,572 discloses an apparatus for analyzing and harmonizing a tune by using results of a tune analysis. A tune in the form of a sequence of notes, as is it played by a keyboard, is read in and separated into tune segments, wherein a tune segment, i.e. a phrase, comprises, e.g., four bars of the tune. A tonality analysis is performed with every phrase, to determine the key of the tune in this phrase. Therefore, the pitch of a note is determined in the phrase and thereupon, a pitch difference is determined between the currently observed note and the previous note. Further, a pitch difference is determined between the current note and the subsequent note. Due to the pitch differences, a previous coupling coefficient and a subsequent coupling coefficient are determined. The coupling coefficient for the current note results from the previous coupling coefficient and the subsequent coupling coefficient and the note length. This process is repeated for every note of the tune in the phrase, for determining the key of the tune and a candidate for the key of the tune, respectively. The key of the phrase is used to control a note type classification means for interpreting the significance of every note in a phrase. The key information, which has been obtained by the tonality analysis, is further used to select a transposing module, which transposes a chord sequence stored in a data bank in a reference key into the key determined by the tonality analysis for a considered tune phrase.

SUMMARY OF THE INVENTION

It is the object of the present invention to provide an improved concept for characterizing and indexing, respectively, the signal that comprises audio content.

The present invention is a method for characterizing a signal which represents an audio content. The method includes the step of determining a measure for a tonality of the signal, wherein the tonality depends on the audio content, and wherein the tonality for a noisy signal differs from the tonality for a tone-like signal, wherein determining a measure for the tonality includes calculating a block of positive and real-valued spectral components for the signal to be characterized; forming a quotient with the geometric mean value of a plurality of spectral components of the block of spectral components as numerator and the arithmetic mean value of the plurality of spectral components in the denominator, wherein the quotient serves as measure for the tonality, wherein a quotient with a value near 0 indicates a tonal signal, and wherein a quotient near 1 indicates an atonal signal with flat spectral curve. The method further includes the step of making a statement about the audio content of the signal based on the measure for the tonality of the signal.

Further, the present invention is a method for generating an indexed signal which comprises an audio content. The method includes the step of determining a measure for a tonality of the signal, wherein the tonality depends on the audio content, and wherein the tonality for a noisy signal differs from the tonality for a tone-like signal, wherein the step of determining a measure for the tonality includes calculating a block of positive and real-valued spectral components for the signal to be characterized; forming a quotient with the geometric mean value of a plurality of spectral components of the block of spectral components as numerator and the arithmetic mean value of the plurality of spectral components in the denominator, wherein the quotient serves as a measure for the tonality, wherein a quotient with a value near 0 indicates a tonal signal, and wherein a quotient near 1 indicates an atonal signal with flat spectral curve. The method further includes the step of recording the measure for the tonality as index in association to the signal, wherein the index refers to the audio content of the signal.

The present invention is an apparatus for characterizing a signal which represents and audio content. The apparatus has means for determining a measure for a tonality of the signal, wherein the tonality depends on the audio content, and wherein the tonality for a noisy signal differs from the tonality for a tone-like signal, wherein the means for determining is configured to calculate a block of positive and real-valued spectral components for the signal to be characterized; and form a quotient with the geometric mean value of a plurality of spectral components of the block of spectral components as numerator and the arithmetic mean value of the plurality of spectral components in the denominator, wherein the quotient serves as a measure for the tonality, wherein a quotient with a value near 0 indicates a tonal signal, and wherein a quotient near 1 indicates an atonal signal with flat spectral curve. The apparatus further has means for making a statement about the audio content of the signal based on the measure for the tonality of the signal.

The present invention is an apparatus for generating an indexed signal which comprises an audio content. The apparatus has means for determining a measure for a tonality of the signal, wherein the tonality depends on the audio content, and wherein the tonality for a noisy signal differs from the tonality for a tone-like signal, wherein the means for determining is configured to calculate a block of positive and real-valued spectral components for the signal to be characterized; and form a quotient with the geometric mean value of a plurality of spectral components of the block of spectral components as numerator and the arithmetic mean value of the plurality of spectral components in the denominator, wherein the quotient serves as a measure for the tonality, wherein a quotient with a value near 0 indicates a tonal signal, and wherein a quotient near 1 indicates an atonal signal with flat spectral curve. Further, then apparatus has means for recording the measure for the tonality as index in association to the signal, wherein the index refers to the audio content of the signal.

The present invention is based on the knowledge that during the selection of a feature for characterizing an indexing, respectively, of a signal, the robustness against distortions of the signal has to be considered particularly. The usefulness of features and feature combinations, respectively, depends on the fact how strongly they are altered by-irrelevant changes, such as by an MP3 encoding.

According to the invention, the tonality of the signal is used as feature for characterizing and indexing, respectively, signals. It has been found that the tonality of a signal, i.e. the property of the signal to have a rather unflat spectrum with distinct lines or rather a spectrum with equally high lines, is robust against distortions of the general type, such as distortions by a lossy encoding method, such as MP3. The spectral representation of the signal is taken as its essence, in reference to the individual spectral lines and groups of spectral lines, respectively. Further, the tonality provides a high flexibility with regard to the required calculating effort, to determine the tonality measure. The tonality measure can be derived from the tonality of all spectral components of a piece, or from the tonality of groups of spectral components, etc. Above that, tonalities of consecutive short-time spectra of the examined signals can be used either individually or weighted or statistically evaluated.

In other words, the tonality in the sense of the present invention depends on the audio content. If the audio content and the considered signal with the audio content, respectively, is noisy or noise-like, it has a different tonality than a less noisy signal. Typically, a noisy signal has a lower tonality value than a less noisy one, i.e. more tonal signal. The latter signal has a higher tonality value.

The tonality, i.e. the noise and tonality of a signal is a quantity depending on the content of the audio signal, which is mostly uninfluenced by different distortion types. Therefore, a concept for characterizing and indexing, respectively, of signals based on a tonality measure provides a robust recognition, which is shown by the fact that the tonality essence of a signal is not altered beyond recognition, when the signal is distorted.

A distortion is, for example a transmission of the signal from a speaker to a microphone via an air transmission channel.

The robustness property of the tonality feature is significant with regard to lossy compression methods.

It has been found out that the tonality measure of a signal is not or only hardly influenced by a lossy data compression, such as according to an MPEG standard. Above that, a recognition feature based on the tonality of the signal provides a sufficiently good essence for the signal, so that two differing audio signals also provide sufficiently different tonality measures. Thus, the content of the audio signal is correlated strongly with the tonality measure.

The main advantage of the present invention is thus that the tonality measure of the signal is robust against interfered, i.e. distorted signals. This robustness exists particularly against a filtering, i.e. equalization, dynamic compression of a lossy data reduction, such as MPEG 1/2 layer 3, an analogue transmission, etc. Above that, the tonality property of a signal provides a high correlation to the content of the signal.

BRIEF DESCRIPTION OF THE DRAWINGS

These and other objects and features of the present invention will become clear from the following description taken in conjunction with the accompanying drawing, in which.

DESCRIPTION OF THE PREFERRED EMBODIMENTS

Figure 1:
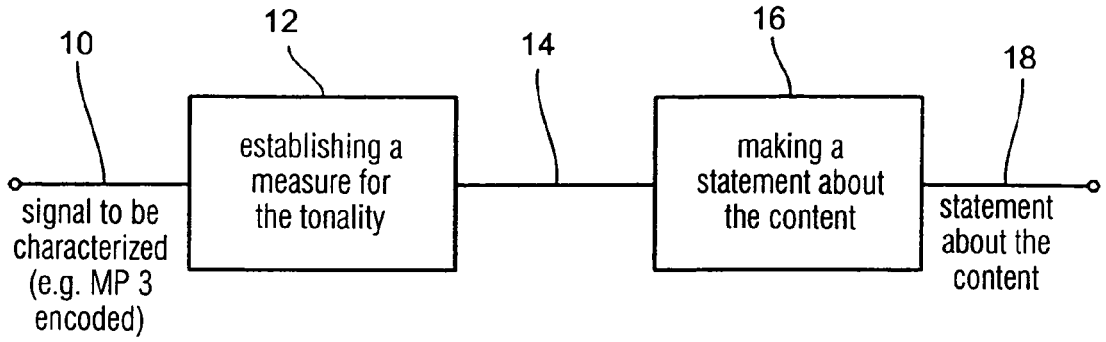
FIG. 1 a schematic block diagram of an inventive apparatus for characterizing a signal.

FIG. 1 shows a schematic block diagram of an inventive apparatus for characterizing a signal, which represents an audio content. The apparatus comprises an input 10, in which the signal to be characterized can be input, the signal to be characterized has been subjected, for example, to a lossy audio encoding in contrast to the original signal. The signal to be characterized is fed into means 12 for determining a measure for the tonality of the signal. The measure of the tonality for the signal is supplied to means 16 via connection line 14 for making a statement about the content of the signal. Means 16 is formed to make this statement based on the measure for the tonality of the signal transmitted by means 12 and provides this statement about the content of the signal at an output 18 of the system.

Figure 2:
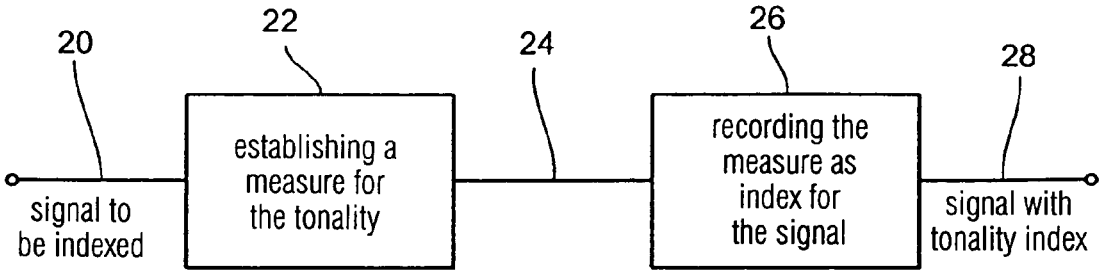
FIG. 2 a schematic block diagram of an inventive apparatus for indexing a signal.

FIG. 2 shows an inventive apparatus for generating an index signal, which has an audio content. The signal, such as an audio piece as it has been generated in the sound studio and stored on a CD, is fed into the apparatus shown in FIG. 2 via input 20. Means 22, which can be constructed generally in the same way as means 12 of FIG. 12, determines a measure for the tonality of the signal to be indexed and provides this measure via a connection line 24 to means 26 for recording the measure as index for the signal. At an output of means 26, which is at the same time the output 28 of the apparatus for generating an indexed signal shown in FIG. 2, the signal fed in at input 20 can be output together with a tonality index. Alternatively, the apparatus shown in FIG. 2 could be formed such that a table entry is generated at output 28, which links the tonality index with an identification mark, wherein the identification mark is uniquely associated to the signal to be indexed. Generally, the apparatus shown in FIG. 2 provides an index for the signal, wherein the index is associated to the signal and refers to the audio content of the signal.

Figure 5:
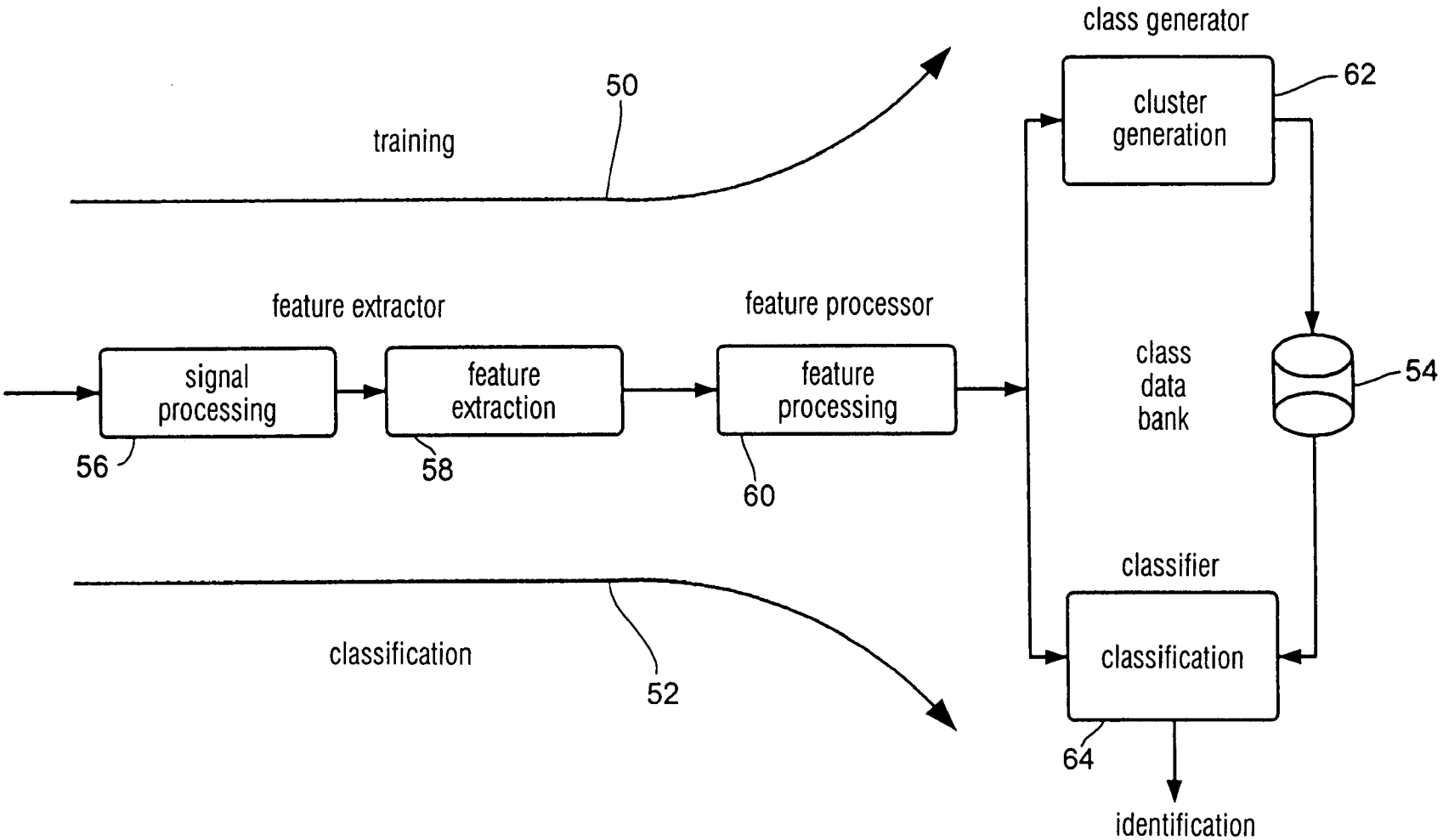
FIG. 5 a schematic block diagram of a structure recognition system, where the tonality measure can be used as feature.

When the apparatus shown in FIG. 2 processes a plurality of signals, a data bank of indices for audio pieces is generated gradually, which can, for example, be used for the pattern recognition system outlined in FIG. 5. Apart from the indices, the data bank optionally contains the audio pieces themselves. Thereby, the pieces can be easily searched with regard to their tonality properties, to identify and classify a piece by the apparatus shown in FIG. 1, with regard to the tonality property and with regard to similarities to other pieces, respectively, and distances between two pieces, respectively. Generally, the apparatus shown in FIG. 2, however, provides a possibility for generating pieces with an associated metadescription, i.e. the tonality index. Thus, it is possible to index and search data sets, such as according to predetermined tonality indices, so that, so to speak, according to the present invention, an efficient searching and finding of multimedia pieces is possible.

Figure 3:
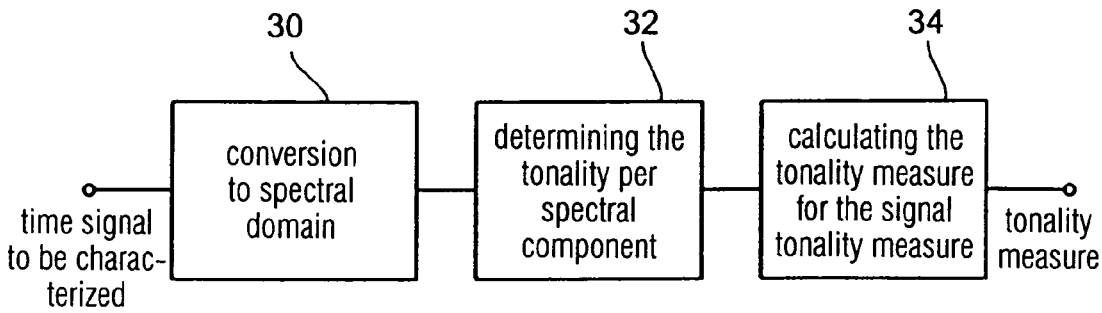
FIG. 3 a schematic block diagram of an apparatus for calculating the tonality measure from the tonality per spectral component.

Different methods can be used for calculating the tonality measure of a piece. As it is shown in FIG. 3, a time signal to be characterized can be converted into the spectral domain by means 30, to generate a block of a spectral coefficients from a block of time samples. As will be explained below, an individual tonality value can be determined for every spectral coefficient and for every spectral component, respectively, to classify, for example via a yes/no determination, whether a spectral component is tonal or not. By using the tonality values for the spectral components and the energy and power of the spectral components, respectively, wherein the tonality values are determined by means 32, the tonality measure for the signal can be calculated via means 34 in a plurality of different ways.

Due to the fact that a quantitative tonality measure is obtained, for example by the concept described in FIG. 3, it is possible to set distances and similarities, respectively, between two tonality indexed pieces, wherein pieces can be classified as similar, when their tonality measures differ only by a difference smaller than the predetermined threshold, while other pieces can be classified as unsimilar, when their tonality indices differ by a difference, which is greater than a dissimilarity threshold. Apart from the difference between two tonality measures, further quantities can be used for the determination of the tonality distance between two pieces, such as the difference between two absolute values, the square of a difference, the quotient between two tonality measurements minus one, the correlation between two tonality measurements, the distance metric between two tonality measures, which are n-dimensional vectors, etc.

It should be noted that the signal to be characterized does not necessarily have to be a time signal, but that it can also be, for example, an MP3 encoded signal, which consists of a sequence of Huffmann code words, which have been generated from quantized spectral values.

Figure 4:
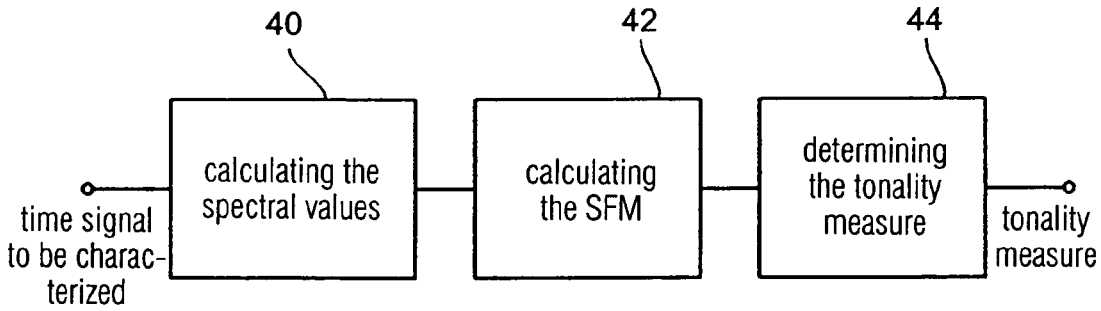
FIG. 4 a schematic block diagram for determining the tonality measure from the spectral flatness measure (SFM)

The quantized spectral values have been generated by quantization from the original spectral values, wherein the quantization has been chosen such that the quantizing noise introduced by the quantization is below the psychoacoustic masking threshold. In such a case, as it is illustrated, for example, with regard to FIG. 4, the encoded MP3 data stream can be used directly to calculate the spectral values, for example via an MP3 decoder (means 40 in FIG. 4). It is not necessary to perform a conversion into the time domain prior to the determination of the tonality and then again a conversion into the spectral domain, but the spectral values calculated within the MP3 decoder can be taken directly to calculate the tonality per spectral component, or, as it is shown in FIG. 4, the SFM (SFM=spectral flatness measure) by means 42. Thus, when spectral components are used for determining of the tonality, and when the signal to be characterized is an MP3 data stream, means 40 is constructed like a decoder, but without the inverse filterbank.

The measure for the spectral flatness (SFM) is calculated by the following equation.

$$SFM = \frac{\left[\prod_{n=0}^{N-1} X(n)\right]^{\frac{1}{N}}}{\frac{1}{N}\sum_{n=0}^{N-1} X(n)}$$

In this equation X(n) represents the square of the amount of a spectral component with the index n, while N stands for the total number of spectral coefficients of a spectrum. It can be seen from the equation that the SFM is equal to the quotient from the geometric mean value of the spectral components to the arithmetic mean value of the spectral components. As is known, the geometric mean value is always smaller or, at the most, equal to the arithmetic mean value, so that the SFM has a range of values, which lies between 0 and 1. In this context, a value near 0 indicates a tonal signal, and a value near 1 indicates a rather noisy signal having a flat spectral curve. It should be noted that the arithmetic mean value and the geometric mean value are only equal when all X(n) are identical, which corresponds to a completely atonal, i.e. noisy or impulsive signal. If, however, in the extreme case, merely one spectral component has a very high value, while other spectral components X(n) have very small values, the SFM will have a value near 0, which indicates a very tonal signal.

The SFM is described in "Digital Coding of Waveforms", Englewood Cliffs, N.J., Prentice-Hall, N. Jayant, P. Noll, 1984 and has been originally defined as a measure for the maximum achievable encoding gain from a redundancy reduction.

From the SFM, the tonality measure can be determined by means 44 for determining the tonality measure.

Another possibility for determining the tonality of the spectral values, which can be performed by means 32 of FIG. 3, is to determine peaks in the power density spectrum of the audio signal, such as is described in MPEG-1 Audio ISO/IEC 11172-3, Annex D1 "Psychoacoustic Model 1". Thereby, the level of a spectral component is determined. Thereupon, the levels of two spectral components surrounding the one spectral component are determined. A classification of the spectral component as tonal takes place when the level of the spectral component exceeds a level of a surrounding spectral component by a predetermined factor. In the art, the predetermined threshold is assumed to be 7 dB, wherein for the present invention, however, any other predetermined thresholds can be used. Thereby, it can be indicated for every spectral component, whether it is tonal or not. The tonality measure can then be indicated by means 34 of FIG. 3 by using the tonality values for the individual component as well as the energy of the spectral components.

Another possibility for determining the tonality of a spectral component is to evaluate the time-related predictability of the spectral component. Here, reference is made again to MPEG-1 audio ISO/IEC 11172-3, Annex D2 "Psychoacoustic Model 2". Generally, a current block of samples of the signal to be characterized is converted into a spectral representation to obtain a current block of spectral components. Thereupon, the spectral components of the current block are predicted by using information from samples of the signal to be characterized, which precede the current block, i.e. by using information about the past. Then, a prediction error is determined, from which a tonality measure can then be derived.

Another possibility for determining the tonality is described in U.S. Pat. No. 5,918,203. Again, a positive real-valued representation of the spectrum of the signal to be characterized is used. This representation can comprise the sums, the squares of the sums, etc. of the spectral components. In one embodiment, the sums or squares of the sums of the spectral components are first logarithmically compressed and then filtered with a filter having a differentiating characteristic, to obtain a block of differentiatingly filtered spectral components.

In another embodiment, the sums of the spectral components are first filtered using a filter having a differentiating characteristic, to obtain a numerator, and then filtered with a filter with an integrating characteristic to obtain a denominator. The quotient from a differentiatingly filtered sum of a spectral component, and the integratingly filtered sum of the same spectral component results in the tonality value for this spectral component.

By these two procedures, slow changes between adjacent sums of spectral components are suppressed, while abrupt changes between adjacent sums of spectral components in the spectrum are emphasized. Slow changes between adjacent sums of spectral components indicate atonal signal components, while abrupt changes indicate tonal signal components. The logarithmically compressed and differentiatingly filtered spectral components and the quotients, respectively, can then again be used to calculate a tonality measure for the considered spectrum.

Although it has been mentioned above that one tonality value is calculated per spectral component, it is preferred with regard to a lower calculating effort, to always add the squares of the sums of two adjacent spectral components, for example, and then to calculate a tonality value for every result of the addition by one of the measures mentioned. Every type of additive grouping of squares of sums and sums, respectively, of spectral components can be used to calculate tonality values for more than one spectral component.

It is another possibility for determining the tonality of a spectral component to compare the level of a spectral component to a mean value of levels of the spectral component in a frequency band. The width of a frequency band containing the spectral component, whose level is compared to the mean value, e.g. the sums or squares of the sums of the spectral components, can be chosen as required. One possibility is, for example, to choose the band to be narrow. Alternatively, the band could also be chosen to be broad, or according to psychoacoustic aspects. Thereby, the influence of short-term power setbacks in the spectrum can be reduced.

Although the tonality of an audio signal has been determined above on the basis of its spectral components, this can also take place in the time domain, which means by using the samples of the audio signal. Therefore, a LPC analysis of the signal could be performed, to estimate a prediction gain for the signal. On the other hand, the prediction gain is inversely proportional to the SFM and is also a measure for the tonality of the audio signal.

In a preferred embodiment of the present invention, not only one value per short-term spectrum is indicated, but the tonality measure is also a multi-dimensional vector of tonality values. So, for example, the short-term spectrum can be divided into four adjacent and preferably non-overlapping areas and frequency bands, respectively, wherein a tonality value is determined for every frequency band, for example by means 34 of FIG. 3 or by means 44 of FIG. 4. Thereby, a 4-dimensional tonality vector is obtained for a short-term spectrum of the signal to be characterized. To allow a better characterization, it would further be preferred, to process, for example, four successive short-time spectra as described above, so that all in all a tonality measure results, which is a 16-dimensional vector or generally an n×m-dimensional vector, wherein n represents the number of tonality components per frame or block of sample values, while m represents the number of considered blocks and short-term spectra, respectively. The tonality measure would then be, as indicated, a 16-dimensional vector. To better accommodate the wave form of the signal to be characterized, it is further preferred to calculate several such, for example, 16-dimensional vectors, and process them then statistically, to calculate, for example, variance, mean value or central moments of higher order from all n×m-dimensional tonality vectors of a piece having a determined length, to thereby index this piece.

Generally, the tonality can thus be calculated from parts of the entire spectrum. It is therefore possible to determine the tonality/noisiness of a sub spectrum and several sub spectra, respectively, and thus to obtain a finer characterization of the spectrum and thus of the audio signal.

Further, short-time statistics can be calculated from tonality values, such as mean value, variance and central moments of higher order, as tonality measure. These are determined by means of statistical techniques using a time sequence of tonality values and tonality vectors, respectively, and therefore provide an essence about a longer portion of a piece.

Above that, differences of tonality vectors successive in time or linearly filtered tonality vectors can be used, wherein, for example, IIR filters or FIR filters can be used as linear filters.

For computing time saving reasons it is also preferred in calculating the SFM (block 42 in FIG. 4) to add or to average, e.g., two squares of sums adjacent in frequency and to perform the SFM calculation on this coarsened positive and real-valued spectral representation. Further, this leads to an increased robustness against narrow-band frequency setbacks as well as to a lower computing effort.

In the following, reference will be made to FIG. 5, which shows a schematical overview of a pattern recognition system where the present invention can be used advantageously. Principally, in the pattern recognition system shown in FIG. 5, a difference is made between two operating modes, namely the training mode 50 and the classification mode 52.

In the training mode, data are "trained in", i.e. fed into the system and finally accommodated in a data bank 54.

In the classification mode it is tried to compare and order a signal to be characterized to the entries present in the data bank 54. The inventive apparatus shown in FIG. 1 can be used in the classification mode 52, when tonality indices of other pieces are present, to which the tonality index of the current piece can be compared to make a statement about the piece. The apparatus shown in FIG. 2 will be advantageously used in the training mode 50 of FIG. 5 to fill the data bank gradually.

The pattern recognition system comprises means 56 for signal preprocessing, downstream means 58 for feature extraction, means 60 for feature processing, means 62 for cluster generation and means 64 for performing a classification, to make, for example as result of the classification mode 52, a statement about the content of the signal to be characterized, such that the signal is identical to signal xy, which has been trained in during an earlier training mode.

In the following, reference will be made to the functionality of the individual blocks of FIG. 5.

Block 54 forms, together with block 58, a feature extractor, while block 60 represents a feature processor. Block 56 converts an input signal to a uniform target format, such as the number of channels, the sample rate, the resolution (in bits per sample), etc. This is useful and necessary, since no requirements can be made about the source where the input signal comes from.

Means 58 for feature extraction serves to restrict the usually large amount of information at the output of means 56 to a small amount of information. The signals to be processed mostly have a high data rate, which means a high number of samples per time period. The restriction to a small amount of information has to take place in such a way that the essence of the original signal, which means its characteristic, does not get lost. In means 58, predetermined characteristic properties, such as generally, for example, loudness, basic frequency, etc. and/or according to the present invention, tonality features and the SFM, respectively, are extracted from the signal. The tonality features thus retrieved are to include, so to speak, the essence of the examined signal.

In block 60, the previously calculated feature vectors can be processed. A simple processing consists of normalizing the vectors. Potential feature processing comprises linear transformations, such as the Karhunen-Loeve transformation (KLT) or linear discriminatory analysis (LDA), which are known in the art. Further transformations, in particular also non-linear transformations can also be used for feature processing.

The class generator serves to integrate the processed feature vectors into classes. These classes correspond to a compact representation of the associated signal. Further, the classifier 64 serves to associate a generated feature vector to a predefined class and a predefined signal, respectively.

The subsequent table provides an overview over recognition rates under different conditions.

| Type of distortion | Recognition rate (loudness as feature) | Recognition rate (SFM as feature) |
|---|---|---|
| MP3 encoding, 96 kbps, 30s portion | 83.9% | 100% |
| MP3 encoding, 96 kbps, 15s portion | 76.1% | 74.1% |

The table illustrates recognition rates by using a data bank 54 of FIG. 5 with a total of 305 pieces of music, the first 180 seconds of each having been trained in as reference data. The recognition rate indicates the percentage of the number of properly recognized pieces in dependency on the signal influence. The second column represents the recognition rate when loudness is used as feature. Particularly, the loudness was calculated in four spectral bands, then a logarithmization of the loudness values was performed, and then a difference formation of logarithmized loudness values for timely successive respective spectral band was performed. The result obtained thereby was used as feature vector for the loudness.

In the last column, the SFM was used as feature vector for four bands.

It can be seen that the inventive usage of the tonality as classification feature leads to a 100% recognition rate of MP3 encoded pieces, when a portion of 30 seconds is considered, while the recognition rates both in the inventive feature and the loudness are reduced as feature, when a shorter portion (such as 15 s) of the signal to be examined is used for the recognition.

As has already been mentioned, the apparatus shown in FIG. 2 can be used to train the recognition system shown in FIG. 5. Generally, the apparatus shown in FIG. 2 can be used to generate metadescriptions, i.e. indices, for any multimedia data sets, so that it is possible to search data sets with regard to their tonality values and to output data sets from a data bank, respectively, which have a certain tonality vector and are similar to a certain tonality vector, respectively.

The invention claimed is:

1. Method for characterizing a signal, which represents an audio content, comprising:

determining a measure for a tonality of the signal, wherein the tonality depends on the audio content, and wherein the tonality for a noisy signal differs from the tonality for a tone-like signal, wherein the step of determining a measure for the tonality comprises:

calculating a block of positive and real-valued spectral components for the signal to be characterized;

forming a quotient with the geometric mean value of a plurality of spectral components of the block of spectral components as numerator and the arithmetic mean value of the plurality of spectral components in the denominator, wherein the quotient serves as measure for the tonality, wherein a quotient with a value near 0 indicates a tonal signal, and wherein a quotient near 1 indicates an atonal signal with flat spectral curve; and making a statement about the audio content of the signal based on the measure for the tonality of the signal.

2. Method according to claim 1, wherein the step of making a statement comprises:

comparing the measure for the tonality of the signal with a plurality of known tonality measures for a plurality of known signals, which represent different audio contents;

determining that the audio content of the signal to be characterized corresponds to the content of a known signal, when the tonality measure of the signal to be characterized has a lower than predetermined deviation from the tonality measure, which is associated with the known signal.

3. Method according to claim 2, further comprising:

outputting a title, an author or other metainformation for the signal to be characterized, when a correspondence is determined.

4. Method according to claim 1, wherein the measure for the tonality is a quantitative quantity, wherein the method further comprises:

calculating a tonality distance between the determined measure for the tonality of the signal and a known tonality measure for a known signal; and indicating a similarity measure for the signal to be characterized, wherein the similarity measure depends on the tonality distance and represents the similarity of the content of the known signal with the content of the signal to be characterized.

5. Method according to claim 1, wherein the signal to be characterized is derived by encoding from an original signal, wherein the encoding comprises a block-wise conversion of the original signal into the frequency domain and a quantizing of spectral values of the original signal controlled by a psychoacoustic model.

6. Method according to claim 1, wherein the signal to be characterized is provided by outputting an original signal via a speaker and by recording via a microphone.

7. Method according to claim 1, wherein at least two spectral components adjacent in frequency are grouped, thereupon not the individual spectral components but the grouped spectral components will be further processed.

8. Method according to claim 1, wherein in the step of determining a short-time spectrum of the signal to be characterized is divided into n bands, wherein a tonality value is determined for every band, wherein further for m successive short-time spectra of the signal to be characterized n tonality values are determined each, and wherein a tonality vector is formed with a dimension, which is equal to m×n, wherein m and n are greater or equal to 1.

9. Method according to claim 8, wherein the measure for the tonality is the tonality vector or a statistic quantity from a plurality of timely successive tonality vectors of the signal to be characterized, wherein the statistic quantity is a mean value, a variance or a central moment higher order or a combination of the above-mentioned statistic quantities.

10. Method according to claim 8, wherein the measure for the tonality is derived from a difference of a plurality of tonality vectors or a linear filtering of a plurality of tonality vectors.

11. Method for generating an indexed signal, which comprises an audio content, comprising:

determining a measure for a tonality of the signal, wherein the tonality depends on the audio content, and wherein the tonality for a noisy signal differs from the tonality for a tone-like signal, wherein the step of determining a measure for the tonality comprises:

calculating a block of positive and real-valued spectral components for the signal to be characterized;

forming a quotient with the geometric mean value of a plurality of spectral components of the block of spectral components as numerator and the arithmetic mean value of the plurality of spectral components in the denominator, wherein the quotient serves as a measure for the tonality, wherein a quotient with a value near 0 indicates a tonal signal, and wherein a quotient near 1 indicates an atonal signal with flat spectral curve; and recording the measure for the tonality as index in association to the signal, wherein the index refers to the audio content of the signal.

12. Method according to claim 11, wherein the step of determining a measure for the tonality comprises:

calculating tonality values for different spectral components or groups of spectral components of the signal; and processing the tonality quantities to obtain the measure for the tonality; and associating the signal with a signal class depending on the measure for the tonality.

13. Method according to claim 11, which is performed for a plurality of signals, to obtain a data bank of references to the plurality of signals together with associated indices which refer to tonality properties of the signals.

14. Apparatus for characterizing a signal, which represents an audio content, comprising:

means for determining a measure for a tonality of the signal, wherein the tonality depends on the audio content, and wherein the tonality for a noisy signal differs from the tonality for a tone-like signal, wherein the means for determining is configured to:

calculate a block of positive and real-valued spectral components for the signal to be characterized; and form a quotient with the geometric mean value of a plurality of spectral components of the block of spectral components as numerator and the arithmetic mean value of the plurality of spectral components in the denominator, wherein the quotient serves as a measure for the tonality, wherein a quotient with a value near 0 indicates a tonal signal, and wherein a quotient near 1 indicates an atonal signal with flat spectral curve; and means for making a statement about the audio content of the signal based on the measure for the tonality of the signal.

15. Apparatus for generating an indexed signal, which comprises an audio content, comprising:

means for determining a measure for a tonality of the signal, wherein the tonality depends on the audio content, and wherein the tonality for a noisy signal differs from the tonality for a tone-like signal, wherein the means for determining is configured to:

calculate a block of positive and real-valued spectral components for the signal to be characterized; and form a quotient with the geometric mean value of a plurality of spectral components of the block of spectral components as numerator and the arithmetic mean value of the plurality of spectral components in the denominator, wherein the quotient serves as a measure for the tonality, wherein a quotient with a value near 0 indicates a tonal signal, and wherein a quotient near 1 indicates an atonal signal with flat spectral curve; and means for recording the measure for the tonality as index in association to the signal, wherein the index refers to the audio content of the signal.

* * * * *